US010981043B2

(12) United States Patent
Roychoudhury

(10) Patent No.: US 10,981,043 B2
(45) Date of Patent: Apr. 20, 2021

(54) TABLE TENNIS TRAINING APPARATUS

(71) Applicant: Rohon Roychoudhury, Bloomfield Hills, MI (US)

(72) Inventor: Rohon Roychoudhury, Bloomfield Hills, MI (US)

( * ) Notice: Subject to any disclaimer, the term of this patent is extended or adjusted under 35 U.S.C. 154(b) by 87 days.

(21) Appl. No.: 16/435,473

(22) Filed: Jun. 8, 2019

(65) Prior Publication Data

US 2020/0384331 A1 Dec. 10, 2020

(51) Int. Cl.
*A63B 69/00* (2006.01)
*A63B 102/16* (2015.01)

(52) U.S. Cl.
CPC ..... *A63B 69/0059* (2013.01); *A63B 2102/16* (2015.10); *A63B 2225/093* (2013.01)

(58) Field of Classification Search
CPC ..... A63B 69/0059; A63B 2102/16; A63B 2225/093
USPC ..... 473/422
See application file for complete search history.

(56) References Cited

U.S. PATENT DOCUMENTS 4,383,685 A * 5/1983 Bishop ..... A63B 69/0071 473/450
4,519,608 A * 5/1985 Gilly ..... A63B 69/38 473/215
4,582,325 A * 4/1986 Yuhara ..... A63B 69/36213 473/215
5,060,942 A * 10/1991 Dalbo ..... A63B 69/38 473/215
5,390,929 A * 2/1995 Todaro ..... A63B 69/3621 473/215
5,439,214 A * 8/1995 Dalbo ..... A63B 69/0024 473/207
5,476,257 A * 12/1995 Bobby ..... A63B 69/0059 473/464
5,658,203 A * 8/1997 Shub ..... A63B 69/0059 473/205
6,582,318 B1 * 6/2003 Halfacre ..... A63B 69/3621 473/215
7,025,689 B2 * 4/2006 Infalt ..... A63B 69/0057 473/257
7,462,116 B2 * 12/2008 Kunsman ..... A63B 69/0059 473/464
7,686,699 B2 * 3/2010 Snyders ..... A63B 69/0059 473/216
2004/0043824 A1 * 3/2004 Uzelac ..... A63B 69/0059 473/266

* cited by examiner

*Primary Examiner* — Joshua T Kennedy
(74) *Attorney, Agent, or Firm* — Brett A. Schenck

(57) ABSTRACT

A training apparatus and method of use for guiding and improving the forehand, backhand and other strokes of a table tennis player by forcing the hand travel in the correct trajectory to strike the ball. The apparatus includes a waist and a chest belt, or a wide belt, to position a vertical rigid rod support to which the training guide is mounted. The training guide includes a plate that can be adjusted in 6 degrees of freedom via a universal joint. There are two universal joints between the plate and the vertical rod support strapped to the player's torso. The position, orientation and the angle of the plate can be adjusted by the player via the two universal joints as required. The training apparatus improves the paddle stroke trajectory by guiding the hand such that the ball is returned to the opposing player bouncing off the table.

15 Claims, 6 Drawing Sheets

TABLE TENNIS TRAINING APPARATUS

TECHNICAL FIELD OF INVENTION

This disclosure generally relates to sports training devices, and more specifically to a table tennis training apparatus and method of use thereof, wherein guide plate(s) attachments to a player's torso facilitate utilization of the correct technique/stroke in the play of table tennis, thereby improving the forehand, backhand and various other strokes of the player.

BACKGROUND OF INVENTION

Training devices have been developed for sports such as tennis and golf to improve the player's game and technique. But none of these devices can be effectively applied to the game of table tennis. In table tennis the trajectory of the arm motion and the paddle angle determines the ability of the player to properly return the ball on to the table within a very short period of time. Since the ball is usually advancing toward the player with a very high rotational and/or translational velocity, improper paddle stroke angle and arm motion can have the spinning ball bounce off in an undesired direction, off the table tennis board.

Therefore there is a need for a training apparatus that can properly guide a table tennis player to the proper arm motion and paddle stroke angle such that the fast/slow approaching spinning ball can be effectively returned every time within the confines of the table tennis board.

SUMMARY OF THE INVENTION

In accordance with one embodiment, a training apparatus for a table tennis player is provided. The training apparatus comprises of a first support configured to be affixed to the torso of the table tennis player. A second support configured to be moveably attached to the first support. A third support configured to be moveably attached to the second support. A guide plane configured to be affixed to the third support.

Key features of the training apparatus adjustment lies in the special universal joint design that allows adjustment in 6 degrees of freedom of the connecting supports and hence the guide plate.

Accordingly, a key feature and advantage of the present invention is its ability to constrain a table tennis player's hand motion trajectory to stroke and return the ball within the confines of the table tennis board, to the opposing player.

Further features and advantages will appear more clearly on a reading of the following detailed description of the preferred embodiments, which is given by way of non-limiting example only and with reference to the accompanying drawings.

BRIEF DESCRIPTION OF DRAWING FIGURES

The present invention will now be described, by way of example with reference to the accompanying drawing figures, in which.

Figure 6:
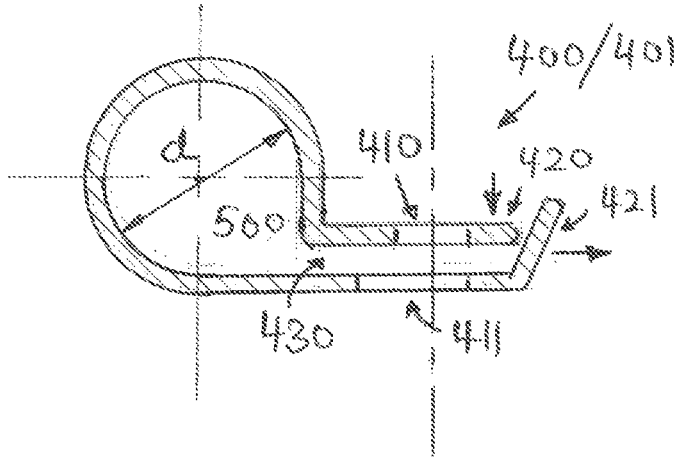
Figure 7:
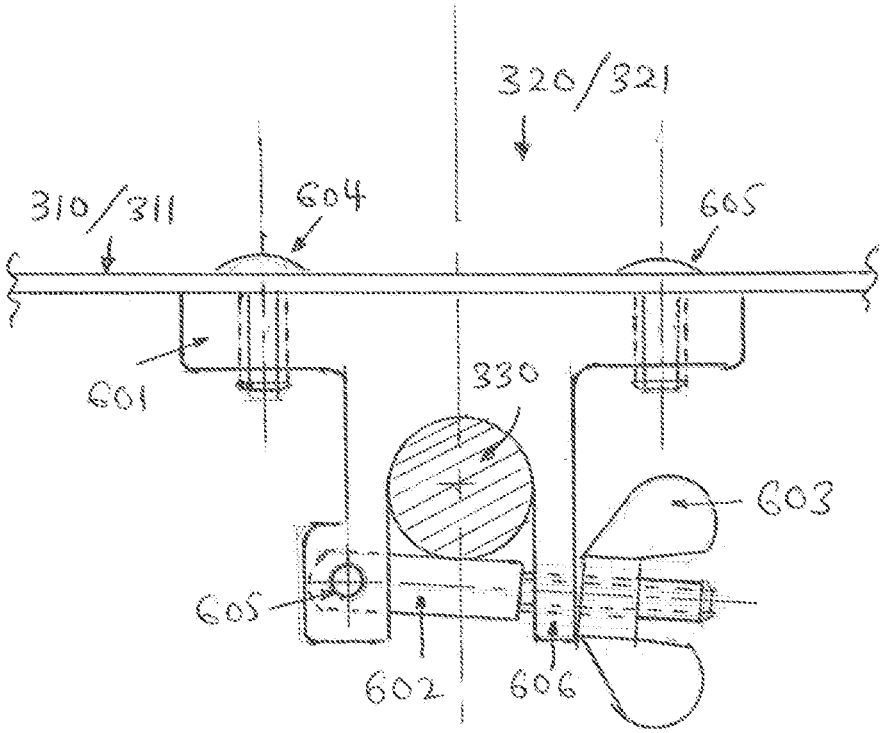

FIG. 6 is a sectional view of one of the components of the universal joint design to illustrate the gripping mechanism of the universal joint on to the mounting support; and FIG. 7 is a top view of the support holder of the first support designed for an easy and quick attachment/detachment of the first support. The support holder is affixed to a belt strapped around the upper torso of the table tennis player.

Reference will now be made in detail to the present preferred embodiments of the table tennis training apparatus, examples of which are illustrated in the accompanying drawing figures.

DETAILED DESCRIPTION

In describing the preferred embodiments of the present invention, as illustrated in FIGS. 1-7, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
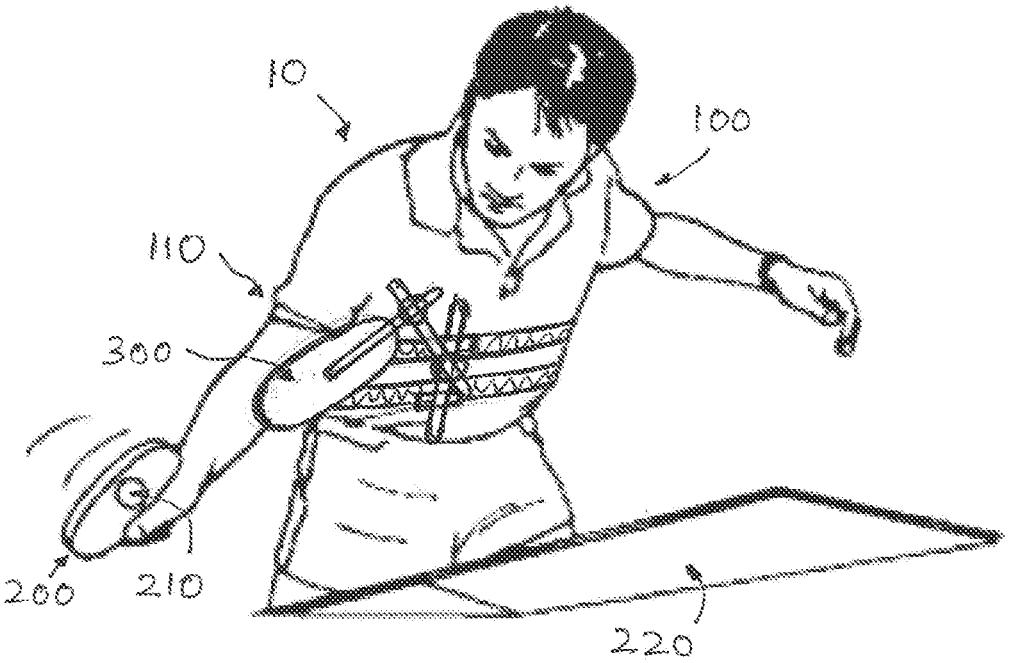
FIG. 1 is a perspective view of a table tennis player equipped with the table tennis training apparatus according to a preferred embodiment of the present invention shown at the start of a player's forehand stroke.
Figure 2:
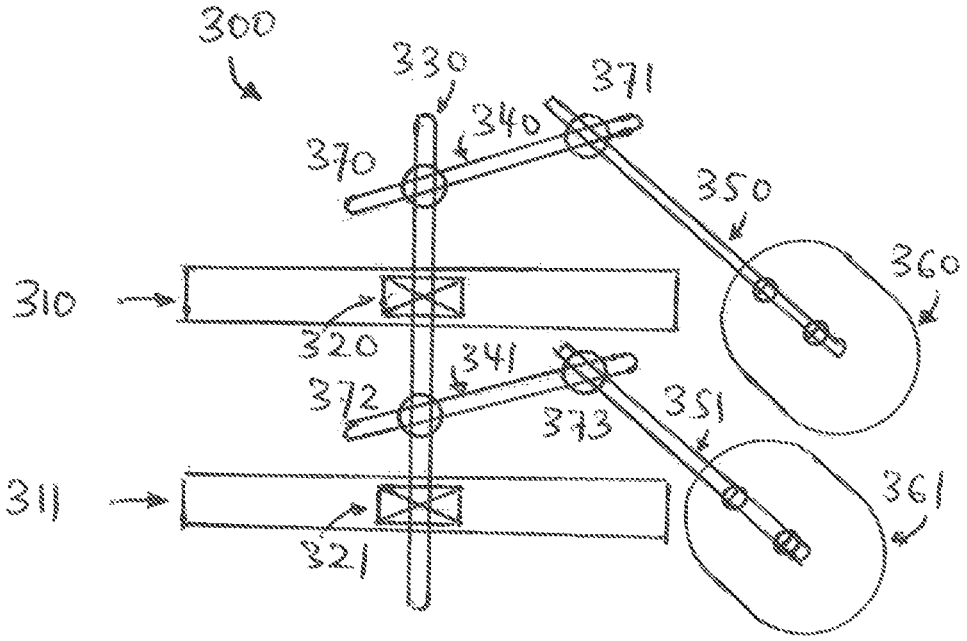
FIG. 2 is a perspective view of the table tennis training apparatus in one embodiment.

Referring now to FIGS. 1-2, the present invention in one embodiment comprises a table tennis training apparatus 300 and associated method of use thereof, wherein table tennis training apparatus 300 preferably comprises the guiding plate 360 affixed to the third support 350. The third support 350 is in turn mounted movably to the second support 340, via a second universal joint 371. The second support 340 is in turn mounted movably to the first support 330, via a first universal joint 370. The first support 330 is affixed vertically to the player's torso 100 as shown with the aid of two belts 310 and 311, and support holder 320 and 321 respectively. The third support 350 presents the plate 360 in the desired position and angle to aid the table tennis player 10 in enabling the proper arm 110 motion to stroke the ball 210 with the table tennis paddle 200 in the desired angle and direction. It may be noted that the supports described here may be constructed from materials such as metal, plastic, wood, composite, etc. The support section may be square, circular or any other geometry to construct a light and stiff structure. And the support section may be solid or hollow or any other combination of hollow and solid geometrical shape/structure. The first and the second universal joints may be identical or of similar designs.

Figure 3:
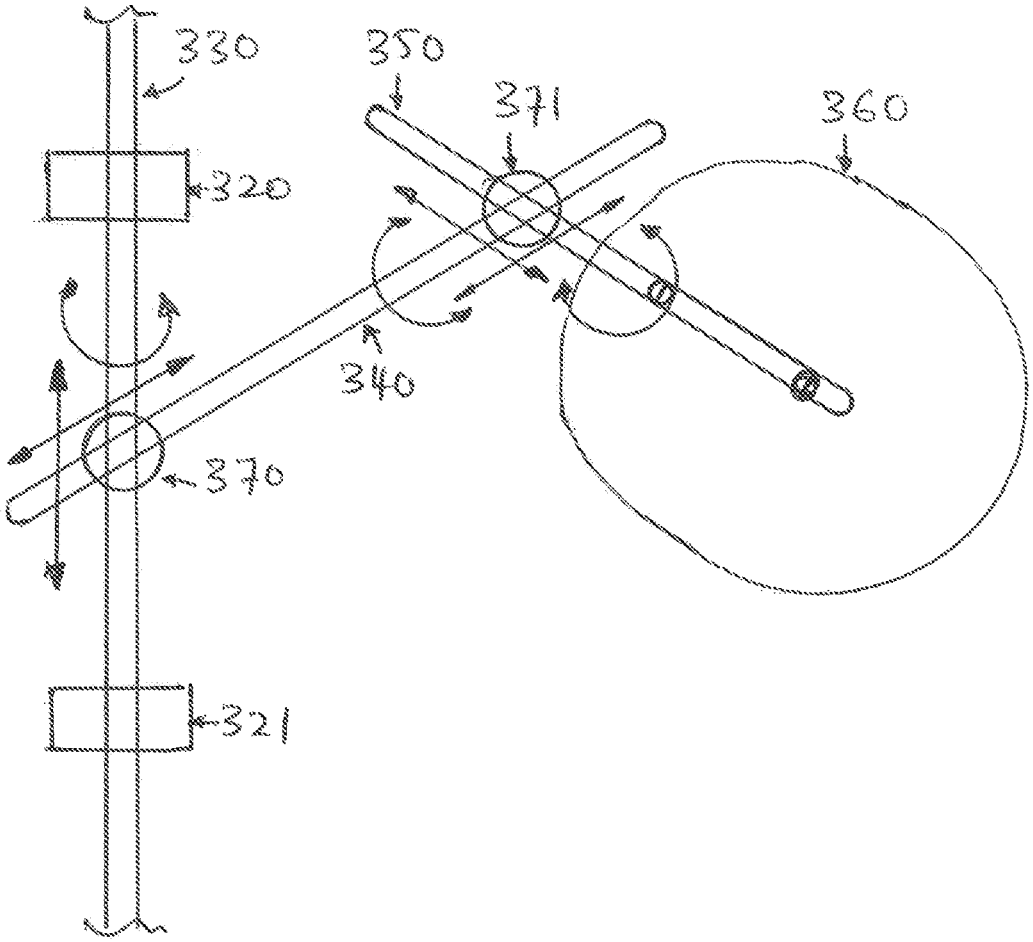
FIG. 3 is a perspective view of one of the first, second and the third supports of the table tennis training apparatus illustrating the wide range of possible adjustments.

FIG. 3 illustrates the range of motion achievable by the guiding plate 360 affixed to the third support 350. The third support 350 is movably mounted to the second support 340 via the second universal joint 371. The second support 340 is moveably mounted to the first support 330 via the first universal joint 370. The first support 330 may be affixed or movably mounted to the table tennis player 10 via the support holders 320 and 321 attached to the belts 310 and 311 respectively, such that any translational or rotational motion of the first support 330 is constrained with respect to the player's torso 100. The first and the second universal joints 370 and 371 may be configured to allow the third and second supports to move rotationally and translationally with respect to the second and first support respectfully. The support holders 320 and 321 are designed to allow for a quick and easy attachment of the first support 330 to the belts 310 and 311 and allow the support 330 to move rotationally and translationally with respect to the torso attachment belts for adjustments.

Figure 4:
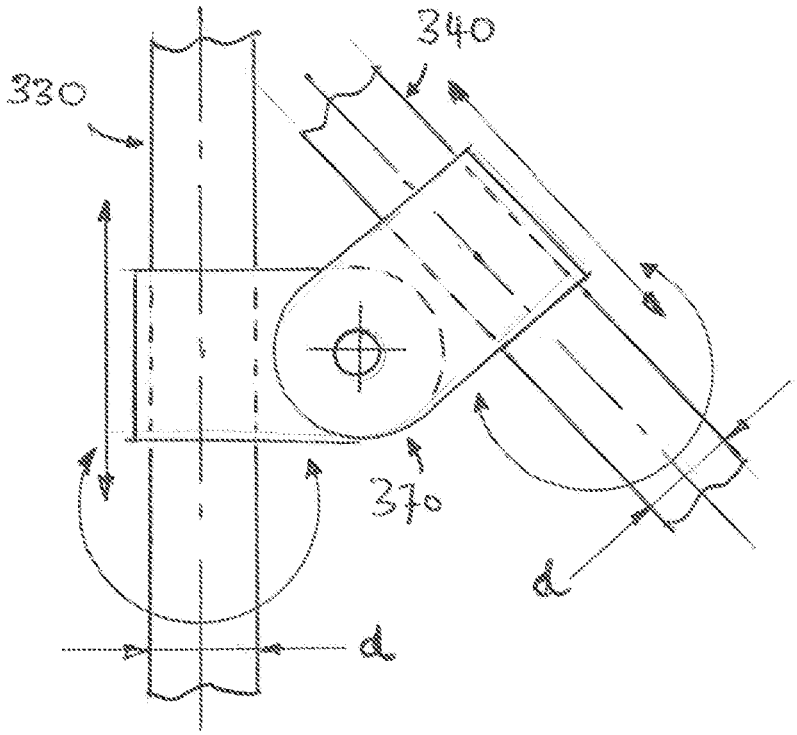
FIG. 4 is a perspective view of an embodiment of a universal joint assembly design illustrating the mechanism of the universal joint, enabling the range of possible support adjustments shown in FIG. 3.

FIG. 4 illustrates the universal joint design 370 connecting the first and the second supports 330 and 340 respectively and the translational and rotational motion that are achievable to provide the 6 degrees of freedom.

Figure 5:
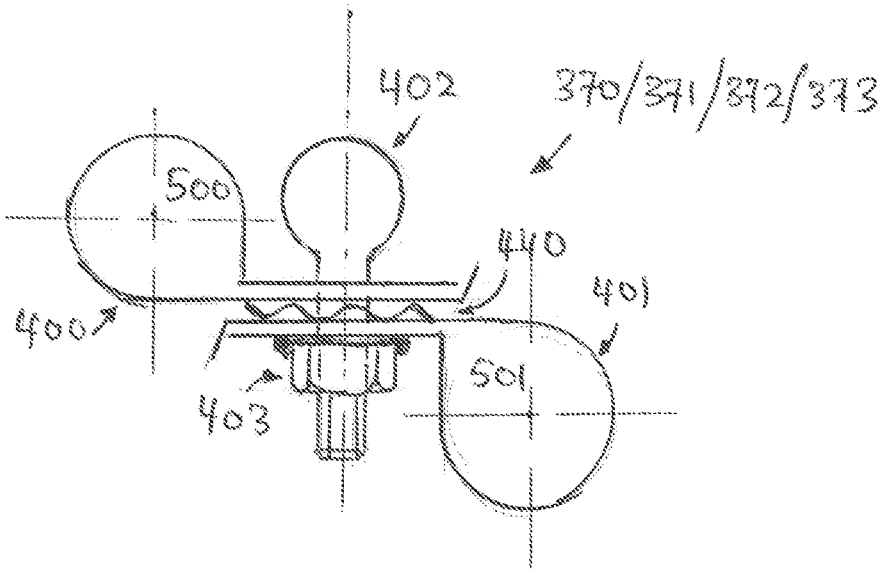
FIG. 5 is a sectional view of an embodiment of a universal joint design to illustrate its assembly and operation.

FIG. 5 is a section view of a non-limiting example of a universal joint configuration that may be employed for the first 370/372 and the second 371/373 universal joints. It is comprised of two clips 400 and 401, placed one on the other in the manner shown and constrained by a wing screw 402 on one side and a nut 403 on the other side. The serrated mating surfaces 440 of the clips 400 and 401 prevent them from rotating on to each other when the wing nut 402 is tightened on to the nut 403. The tightening of the wing nut 402 on to the nut 403 also initiates the opening 500 and 501 of the clips 400 and 401 respectively to constrict, thereby tightening on to the connecting supports, thus preventing the supports from any translational or rotational movement. The nut 403 may be welded to the clip 401 to prevent it from rotating and/or disengaging itself. It may be noted that the universal joints described here may be constructed from materials such as metal, plastic, composite, etc.

FIG. 6 is a sectional view of the clip 400, illustrating the mechanism by which the opening 500 constricts upon tightening the wing screw 402 onto the nut 403. This is accomplished by allowing a small gap 430 between the members 420 and 421 of the clip 400/401. As the end of the member 420 rests on the inclined plane of the end of the member 421, closure of the gap 430 between the members 420 and 421, forces them to slide with respect to each other as indicated by the arrows shown. This additional sliding movement adds to the constriction of the opening 500 along with the gap 430 reduction. To help facilitate the sliding motion of the members 420 and 421, the aperture 411 in the member 421, with the incline end, is elongated, in the direction of motion, as shown. Whereas the aperture 410 in the member 420 may be retained as circular.

FIG. 7 illustrates an embodiment of support holders 320/321 of the support 330. The support holders 320/321 are affixed to the belts 310/311 respectively. The belts 310/311 are a component of the training apparatus 300, affixing the training apparatus 300 to the player's upper torso 100.

The foregoing description and drawings comprise illustrative embodiments of the present invention. Having thus described the exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains, having the benefit of the teachings presented in the foregoing descriptions and the associated drawings. Although specific terms may be employed herein, they are used in a generic and descriptive sense only and not for the purposes of limitation. Accordingly, the present invention is not limited to the specific embodiments illustrated herein, but is limited only by the following claims.

What is claimed is:

1. A training apparatus for a table tennis player comprising:

a first support configured to be affixed to a torso of the table tennis player;

a second support translationally and rotationally attached to the first support;

a third support translationally and rotationally attached to the second support;

a guide plate affixed to the third support, wherein the guide plate moves with the third support;

a first universal joint, wherein the second support is translationally and rotationally attached to the first support via the first universal joint; and a second universal joint, wherein the third support is translationally and rotationally attached to the second support via the second universal joint, such that the third support presents the guide plate in a position and angle configured to be in front of an arm of the table tennis player to constrain forward movement of the arm of the table tennis player, thus enabling a proper arm stroke.

2. The training apparatus of claim 1, wherein the second support, third support, and guide plate move in respective parallel planes.

3. The training apparatus of claim 1, wherein the third support is rotationally and translationally attached to the second support via the first universal joint, wherein the first universal joint comprises first and second clips placed on each other, wherein the first clip includes a first opening receiving the second support, wherein the second clip includes a second opening receiving the third support, wherein the training apparatus further comprises a fastener, wherein the fastener fastens the first clip to the second clip, wherein the fastener may be operatively moved to a first position to tighten the first clip to the second clip to prevent the first clip from moving relative to the second clip, wherein the fastener may be operatively moved to a second position to untighten the first clip from the second clip and enable the first clip to rotate relative to the second clip and the second support to move relative to the third support.

4. The training apparatus of claim 1 further comprising a support holder and a torso belt, wherein the first support is configured to be affixed to the torso of the table tennis player via the torso belt and the support holder, wherein the first support is attached to the torso belt by the support holder, wherein the support holder is configured to enable the first support to move rotationally and translationally with respect to the torso belt for adjustments.

5. The training apparatus of claim 1, wherein the first support is a rigid member configured to be in alignment with the torso of the tennis player and constrained from any translational or rotational motion with respect to the torso.

6. The training apparatus of claim 1 wherein the second support is a rigid member, wherein the second support is moveably attached to the first support such that the second support can move translationally and rotationally with respect to the first support.

7. The training apparatus of claim 1 wherein the third support is a rigid member, wherein the third support is moveably attached to the second support such that the third support can move translationally and rotationally with respect to the second support.

8. The training apparatus of claim 1, wherein the first universal joint is configured to enable translational and rotational movement of the first support member and the second support in 6 degrees of freedom.

9. The training apparatus of claim 1, wherein the second universal joint is configured to enable adjustment of the guide plate in 6 degrees of freedom.

10. A training apparatus for a table tennis player comprising:

a first support configured to be affixed to a torso of the table tennis player;

a second support rotationally and translationally attached to the first support;

a third support rotationally and translationally attached to the second support;

a guide plate affixed to the third support, wherein the guide plate moves with the third support;

a first universal joint, wherein the third support is rotationally and translationally attached to the second support via the first universal joint, wherein the first universal joint comprises first and second dips placed on each other, wherein the first clip includes a first opening receiving the second support, wherein the second clip includes a second opening receiving the third support; and a fastener, wherein the fastener fastens the first clip to the second clip, wherein the fastener may be operatively moved to a first position to tighten the first clip to the second clip to prevent the first clip from moving relative to the second clip and to constrict the first and second openings to prevent translational and rotational movement of the second and third supports, respectively, wherein the fastener may be operatively moved to a second position to untighten the first clip from the second clip and enable the first clip to rotate relative to the second clip and the second support to move relative to the third support.

11. The training apparatus of claim 10 wherein the fastener comprises a wing screw and a wing nut, wherein the wing screw extends through the first and second clips and is tightened onto the wing nut by turning the wing screw to thereby tighten the first clip to the second clip in the first position of the fastener.

12. The training apparatus of claim 10, wherein the first clip includes a first side and the second clip includes a second side, wherein the first and second sides face each other when the first and second clips are fastened to each other, wherein each of the first and second sides have serrated mating surfaces that prevent the first and second clips from moving relative to each other when the fastener is in the first position.

13. The training apparatus of claim 10, wherein the first clip comprises:

a constricting portion defining the second opening;

a first member attached to the constricting portion and extending radially outwardly from the constricting portion;

a second member attached to the constricting portion and extending radially outwardly from the constricting portion, wherein the second member is spaced opposite the first member by a gap, wherein the fastener extends through the first and second members, wherein movement of the fastener from the second position to the first position to tighten the first and second clips to each other causes the first and second member to move towards each other and constrict the second opening.

14. The training apparatus of claim 13, wherein the first member includes a first distal end, wherein the second member includes a second distal end that extends towards the first member and slopes away from the second opening, wherein the first distal end of the first member engages an inner side of the second distal end of the second member, wherein movement of the second member towards the first member causes the first distal end to slide along the inner side of the second distal end thereby causing the second member to move radially outwardly relative to the first member to further constrict the second opening.

15. The training apparatus of claim 14, wherein the second member includes an aperture for receiving the fastener, wherein the aperture is elongated in the longitudinal direction of the second member to facilitate the radially outward movement of the second member.

* * * * *